US005338021A

United States Patent [19]

Shirai

[11] Patent Number: 5,338,021

[45] Date of Patent: Aug. 16, 1994

[54] PAPER FEEDING MECHANISM

[75] Inventor: Masami Shirai, Saitama, Japan

[73] Assignee: Asahi Kogaku Kogyo Kabushiki Kaisha, Tokyo, Japan

[21] Appl. No.: 24,213

[22] Filed: Mar. 1, 1993

[30] Foreign Application Priority Data

Feb. 27, 1992 [JP] Japan ..... 4-018415[U]

[51] Int. Cl.[5] ..... B63H 1/12

[52] U.S. Cl. ..... 271/160; 271/127; 271/164

[58] Field of Search ..... 271/126, 127, 147, 160, 271/162, 164; 221/198, 46

[56] References Cited

U.S. PATENT DOCUMENTS

| | | | |
|---|---|---|---|
| 4,269,407 | 5/1981 | Tsuda et al. | 271/160 X |
| 4,280,692 | 7/1981 | Hutchinson et al. | 271/160 |
| 5,232,214 | 8/1993 | Matsuura et al. | 271/160 X |
| 5,232,215 | 8/1993 | Hashimoto et al. | 271/160 |

FOREIGN PATENT DOCUMENTS

| | | | |
|---|---|---|---|
| 0178122 | 7/1990 | Japan | 271/160 |

*Primary Examiner*—Robert P. Olszewski
*Assistant Examiner*—Carol L. Druzbick
*Attorney, Agent, or Firm*—Sandler Greenblum & Bernstein

[57] ABSTRACT

A sheet cassette is disclosed for accommodating cut sheets therein, and is detachably coupled to an apparatus to which the cut sheets are to be fed. The sheet cassette is provided with a cassette housing, and a supporting plate, provided in the cassette housing, for supporting the cut sheets thereon and being movable in a vertical direction transverse to the feeding direction of the cut sheets. The sheet cassette further includes at least one spring for biasing the supporting plate upwardly, and a lever for preventing the movement of the supporting plate upwardly while the cassette housing is being inserted into the apparatus and allowing the movement of the supporting plate when the cassette housing is coupled to the apparatus.

16 Claims, 7 Drawing Sheets

PAPER FEEDING MECHANISM

BACKGROUND OF THE INVENTION

The present invention relates to a sheet feeding mechanism for feeding cut sheets accommodated in a sheet cassette to, for example, an imaging apparatus.

There is an imaging apparatus such as a copying machine, printer, facsimile or the like, which prints on respective cut sheets of various sizes.

Usually in such an imaging apparatus, in order to facilitate printing on cut sheets of various sizes, removable sheet cassettes are used. One sheet cassette accommodates cut sheets of a predetermined size and is inserted into the apparatus. Accordingly, the image is formed on a cut sheet of the desired size by inserting the sheet cassette that has the required cut sheet.

In the imaging apparatus, a pick up roller is provided in order to pick up the cut sheet individually from the sheet cassette. Usually, the conventional apparatus is constructed such that the pick up roller contacts the uppermost one of the cut sheets when the sheet cassette has been completely inserted in the apparatus.

On the other hand, until the sheet cassette has been completely inserted in the apparatus, contact of the pick up roller with the uppermost cut sheet must be avoided for preventing the uppermost cut sheet from jamming by the pick up roller. Therefore, the conventional apparatus is constructed as follows, in order to avoid the above problem. Firstly, a path for guiding the sheet cassette is provided in the apparatus so that the pick up roller does not contact the uppermost cut sheet while the sheet cassette is being placed in the apparatus. Secondly, after placement of the sheet cassette has been completed, the sheet cassette is rocked upward toward the pick up roller. Thus, the sheet cassette has been completely inserted in the apparatus and the contact of the pick up roller with the uppermost cut sheet is accomplished.

In the construction as mentioned above, the conventional apparatus has the following problems. Firstly, since the space, where the cassette can be rocked upward, is needed, the apparatus has a larger size than is necessary. Secondly, the operator must place and rock the sheet cassette whenever he or she wants to change the paper size or replenish the cut sheets.

SUMMARY OF THE INVENTION

It is therefore an object of the invention to provide an improved mechanism such that a sheet cassette can be inserted into an imaging apparatus without requiring the additional space necessary for the upward rocking action of the sheet cassette.

In order to accomplish the above-mentioned object, according to one aspect of the present invention, there is provided a combination of a sheet cassette for accommodating cut sheets and an apparatus to which the sheet cassette is detachably coupled and the cut sheet is fed from the sheet cassette. The apparatus includes a pick-up roller for picking up the cut sheets individually from the sheet cassette; and a straight guide path for guiding the sheet cassette therein. The sheet cassette includes biasing means for biasing the cut sheet toward the pick-up roller while the sheet cassette is coupled to the apparatus; and restraining means for preventing contact between the cut sheet and the pick-up roller while the sheet cassette is being inserted into the apparatus. The apparatus further includes releasing means for releasing the restraining means thereby allowing contact when the sheet cassette is coupled to the apparatus.

According to the other aspect of the present invention, there is provided a cut sheet feeding mechanism, including a main body, means for accommodating cut sheets therein, and being detachably coupled to the main body, and means for guiding the accommodating means in a straight path in said main body. There is further provided means provided in the main body, for picking-up the cut sheets individually from the accommodating means; means for biasing the cut sheet toward the pick-up means while the accommodating means is coupled to the main body; and means for preventing contact between the cut sheet and the pick-up means while the accommodating means is being inserted into the main body, and allowing the contact when the accommodating means is coupled to the apparatus.

According to the different aspect of the present invention, there is provided a sheet cassette for accommodating cut sheets therein and being detachably coupled to an apparatus to which the cut sheets are to be fed. The sheet cassette includes a cassette housing, and supporting means, provided in the cassette housing, for supporting the cut sheets thereon and being movable in a predetermined direction transverse to the feeding direction of the cut sheets. The sheet cassette further includes biasing means for biasing the supporting means in the predetermined direction, and restraining means for preventing the movement of the supporting means in the predetermined direction while the cassette housing is being inserted into the apparatus and allowing the movement of the supporting means when the cassette housing is coupled to the apparatus.

The above and other objects, features and advantages of the present invention will become apparent from the following detailed description which is to be read in conjunction with the accompanying drawings.

DESCRIPTION OF THE ACCOMPANYING DRAWINGS

DESCRIPTION OF THE PREFERRED EMBODIMENT

Figure 1:
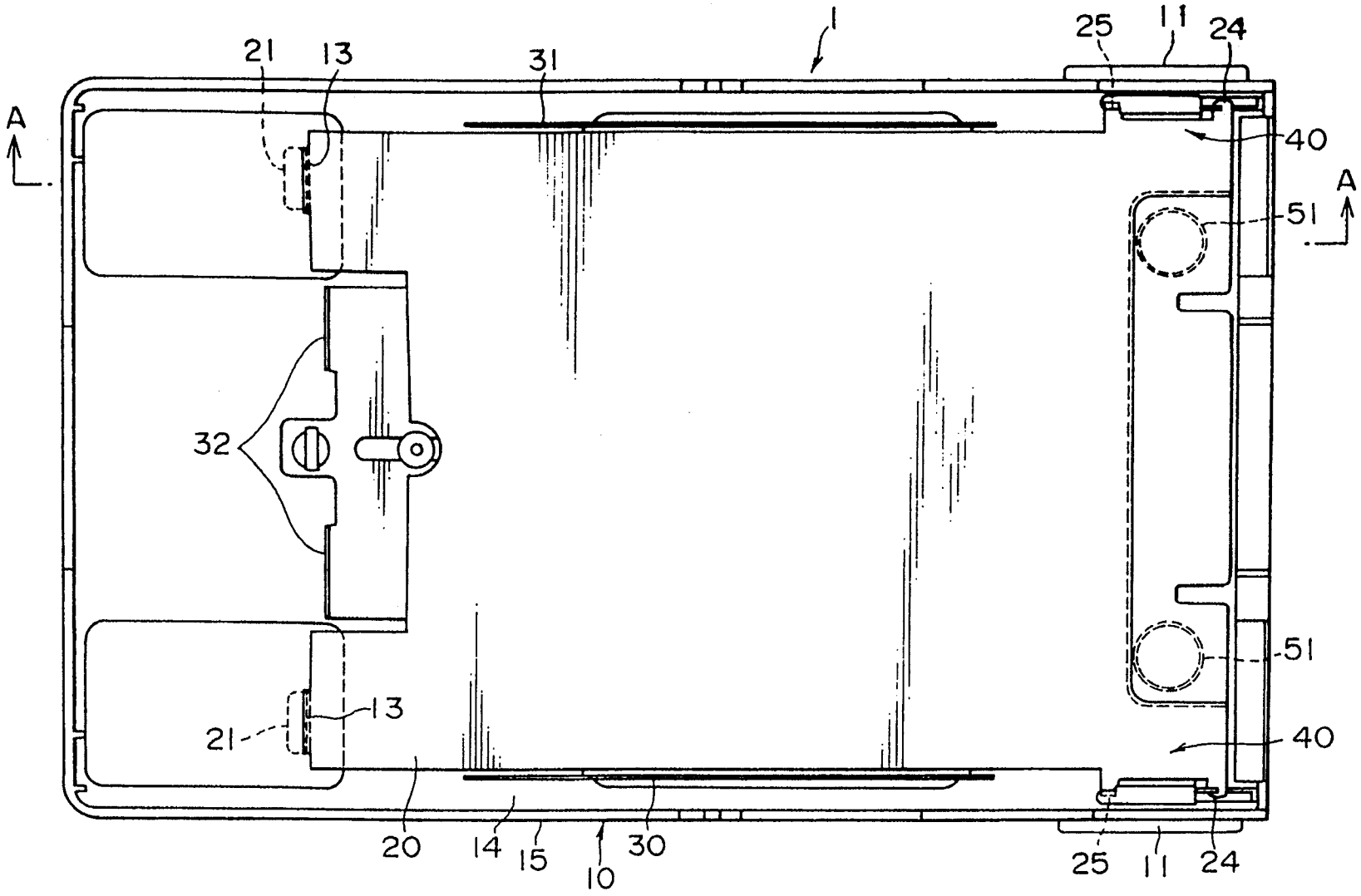
FIG. 1 is a top view showing a sheet cassette embodying the present invention.
Figure 2:
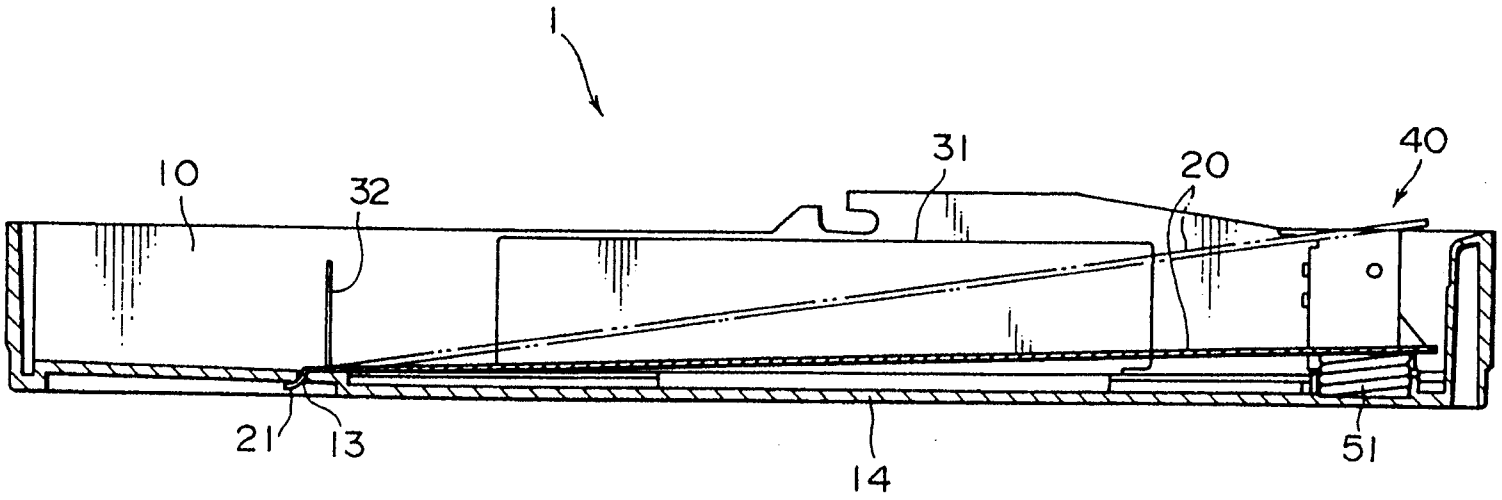
FIG. 2 is a side view showing a sheet cassette embodying the present invention.

FIGS. 1 and 2 show a top and side views of a sheet cassette 1 embodying the present invention, respectively. The sheet cassette 1 is provided with a container 10 for accommodating the cut sheets of a predetermined size, blocking elements 31 and 32 and other hardware mentioned later, and a cover for covering the container 10 (not shown in FIGS. 1 and 2). The sheet cassette 1 is detachably coupled to an imaging apparatus 2, as mentioned later in detail.

The container 10 is shaped as a rectangular box in order to accommodate cut sheets. The container 10 has enough height to accommodate many cut sheets therein. Guide rails 11 are provided at side walls 15 and extend in the longitudinal direction of the container 10.

The cut slicers are placed on a plate 20 provided in the container 10 and accommodated in a space surrounded by blocking elements 30, 31 and 32 and fed in a feed or picked up direction.

The plate 20 is hinged so as to be movable in a predetermined direction transverse the feeding direction of the cut sheets to a bottom plate 14 of the container 10 by two engaging protrusions 21 formed at the end of the plate 20, which are inserted into holes 13 formed on the bottom plate 14. Between the bottom surface of the unhinged end of the plate 20 and the top surface of the bottom plate 14, springs 51 are provided so that the plate 20 is pushed away from the bottom plate 14. At side edges of the unhinged end of the plate 20, two protrusions 24 are formed such that they extend toward the corresponding side walls 15, respectively. At the side edges of the unhinged end of the plate 20 near the protrusions 24, other protrusions 25 are formed such that they extend toward the corresponding side walls 15, respectively.

Figure 3:
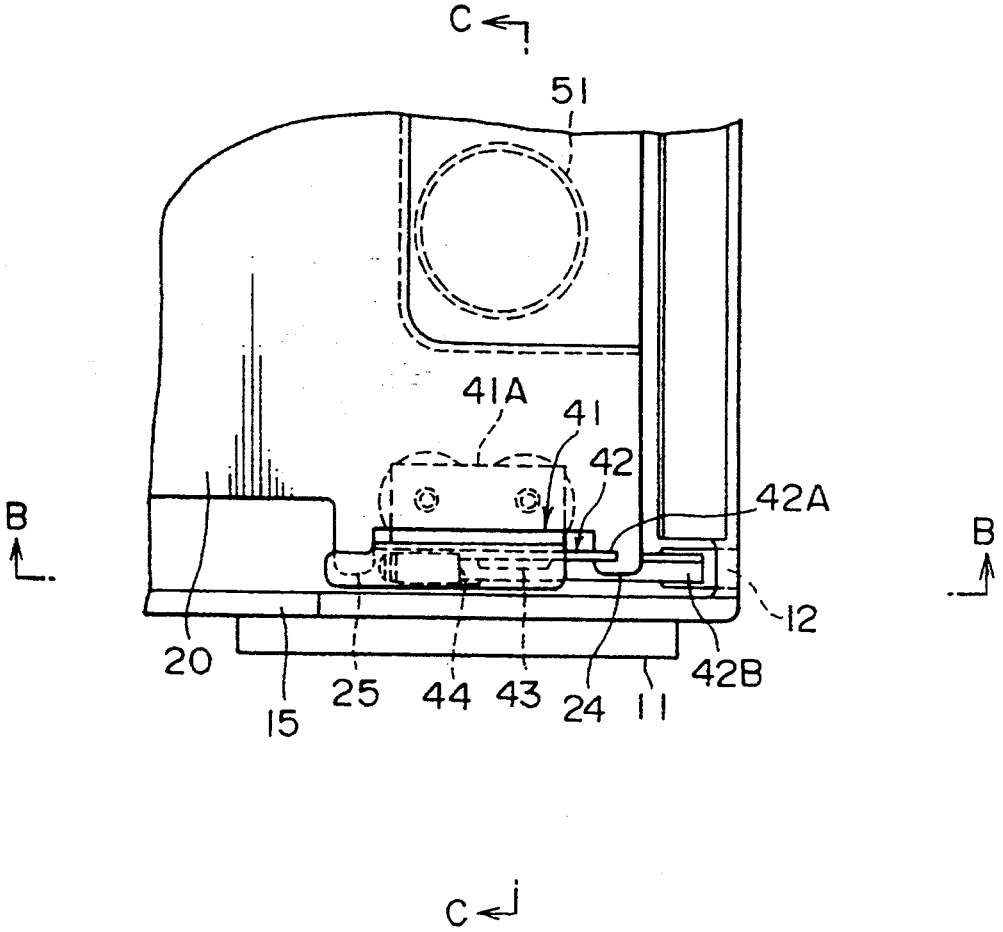
FIG. 3 is an enlarged top view of a stopper mechanism provided in the corner of a sheet cassette.
Figure 5:
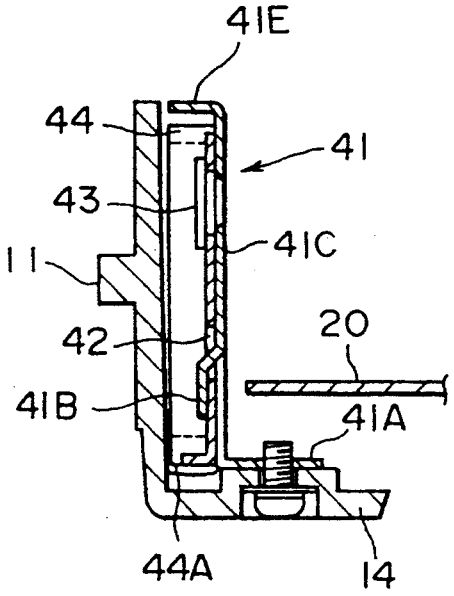
Fig. 5 is a cross-sectional view taken along the line C—C of FIG. 3.

FIGS. 3 and 5 show an enlarged view of stopper mechanisms 40 provided In the front corners of the sheet cassette 1. The stopper mechanisms 40 are provided as restraining means for preventing the movement of the plate 20 in a vertical direction or a direction perpendicular to the feeding direction while the container 10 is being inserted into the imaging apparatus 2 and allowing the movement of the plate 20 when the container 10 is coupled to the imaging apparatus 2. A plate 41 of each of the stopper mechanisms 40 stands on the bottom plate 14, extending in a direction perpendicular to the bottom plate 14 and positioned between the plate 20 and each of the side walls 15.

Figure 4:
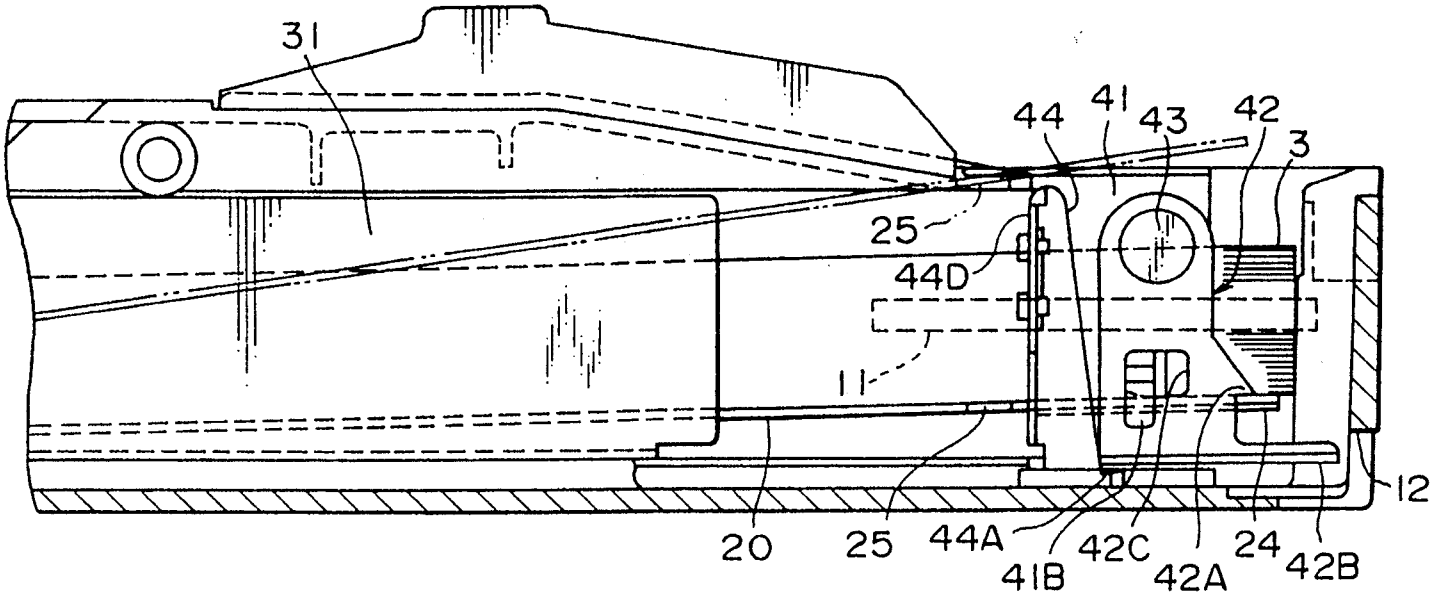
FIG. 4 is an enlarged side view of the sheet cassette with the side wall removed.

A bottom section 41A formed to each of the plates 41 is fixed to the bottom plate 14 by screws. A vertical section 41C of each of the plates 41 has a protrusion 41B which is positioned at a predetermined height along the corresponding vertical sections 41C. At the side of each of the vertical section 41C another vertical section 41D is formed toward each of the side walls 15 and perpendicular to time bottom plate 14 as shown in FIG. 4. At the top of each of the vertical sections 41C, an upper section 41E is formed toward each of the side walls 15 and horizontally to the bottom plate 14.

FIG. 4 shows a side view of the sheet cassette, partly enlarged. An arm 42 is attached to each of the vertical sections 41C by a pin 43 parallel to the bottom plate 14 and perpendicular to the feeding direction, so that the arm 42 can be rotated around the pin 43 within a plane extending in the feeding direction and perpendicular to the bottom plate 14. At the side front edge of each of the arm 42, a triangular protrusion 42A is integrally formed. Each of protrusions 42A has a bottom edge parallel and a slant edge inclined to the bottom plate 14, respectively.

At the lower part of each of the arms 42, a lever 42B, which extends toward an opening 12 formed on each of both sides of the front corners of the sheet cassette 1, is integrally formed. On a predetermined portion of each of the arms 42, an opening 42C is formed, and each of the protrusion 41B is inserted therein. On the left side of the arm 42, as shown in FIG. 4, a leaf spring 44 is fixed to each of the vertical sections 41D so as to apply a counterclockwise rotating force to the arm 42. The counterclockwise rotation of each of the arms 42 is prohibited when the left side edge of the opening 42C contacts the left side edge of the protrusion 41B as shown in FIG. 4.

In the condition, as shown in FIG. 1 or 4, the horizontal edge of the protrusion 42A blocks the protrusion 24. Accordingly, even though the plate 20 is pushed away from the bottom plate 14 by the springs 51, counterclockwise rotation of the plate 20, as shown in FIG. 4, is prohibited by a predetermined amount.

When each of the levers 42B is moved away from the corresponding opening 12 by a protrusion 91, as mentioned later in detail, the arm 42 is rotated clockwise against the counterclockwise force exerted by the leaf spring 44. In accordance with the clockwise rotation of the arm 42, the bottom edge of the protrusion 42A moves so as to lose the contact with the protrusion 24, in other words, moves backwards. When the protrusion 42A is released from or loses the contact with the protrusion 24, the plate 20 is no longer blocked by protrusion 42A. As a result, the plate 20 is rotated counterclockwise by the force of the spring 51.

The counterclockwise rotation of the plate 20 continues until the protrusion 25 (one dash and two dots line position in FIG. 4) contacts the upper section 41E. Thus, the counterclockwise rotation of the plate 20 is restricted to a predetermined range by both the protrusion 25 and the upper section 41E.

Hereinafter, the construction of the imaging apparatus 2 will be described.

Figures 6A, 6B:
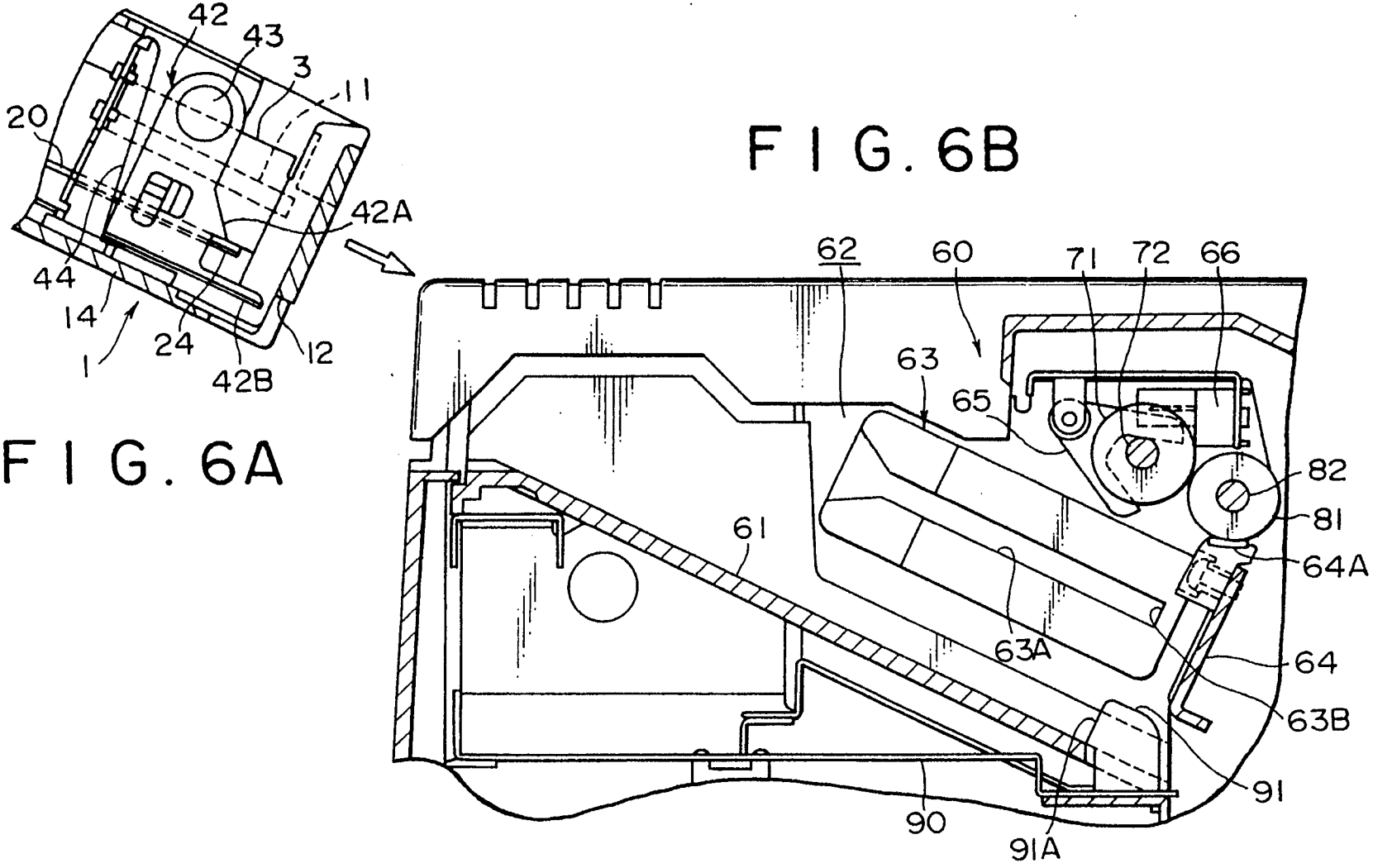
FIG. 6A is an enlarged cross-sectional view of a sheet cassette that not yet been inserted into an imaging apparatus.
FIG. 6B is an enlarged cross-sectional view of an imaging apparatus showing an area where the sheet cassette is inserted.
Figure 7:
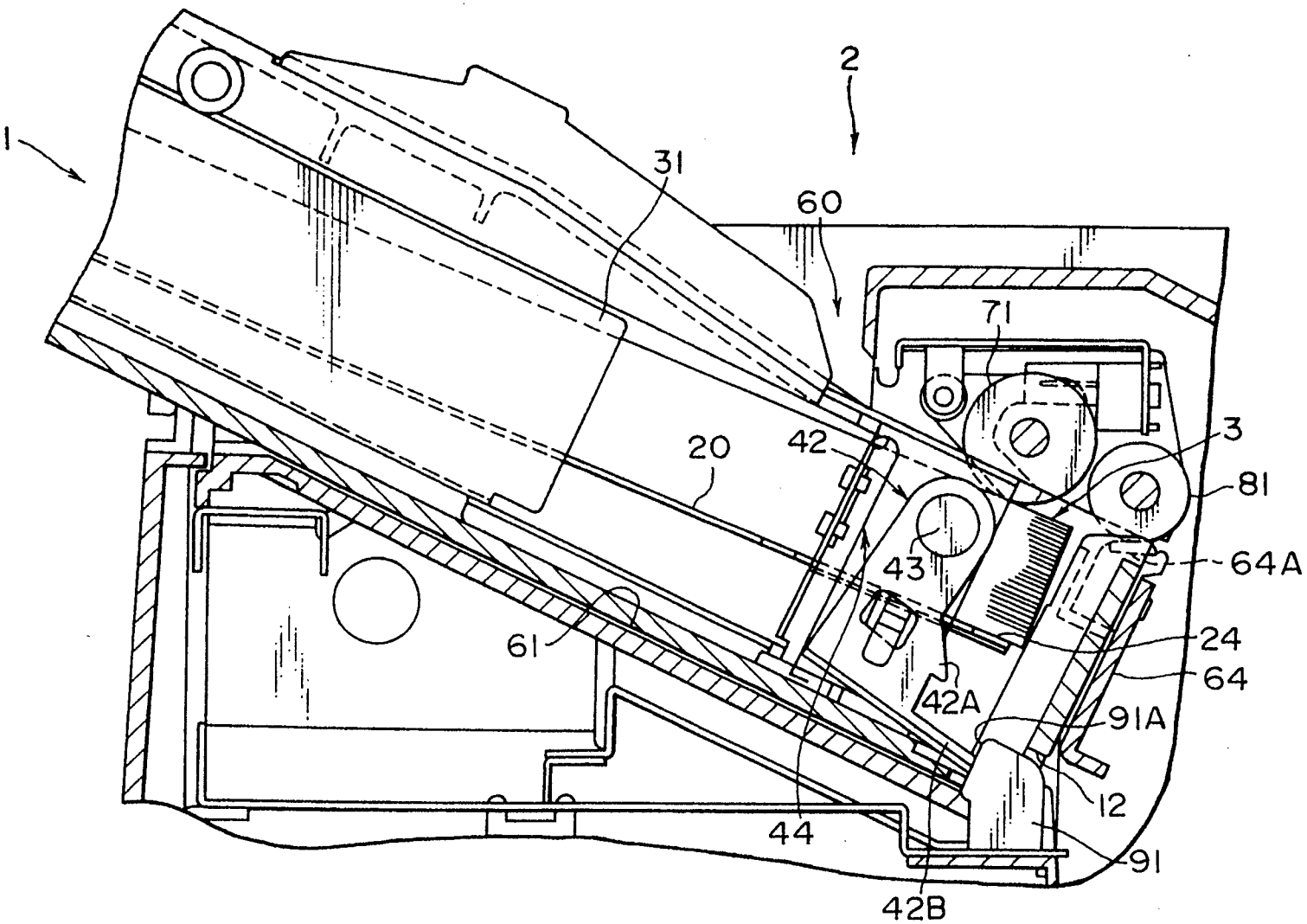
FIG. 7 is an enlarged cross-sectional view of an imaging apparatus having the sheet cassette completely inserted.

FIG. 6B shows the cross-sectional view of the imaging apparatus 2. A space 60, where the sheet cassette 1 is inserted, is provided in the apparatus 2. The space 60 is bordered by a supporting plate 61 and two side plates 62. When the sheet cassette 1 is inserted in the space 60, the bottom plate 14 contacts the supporting plate 61. The width of the space between the two side plates 62 is designed to correspond the width of the sheet cassette 1. At a predetermined height of the side plates 62, straight guide grooves 63A are formed.

The position of each of the guide grooves 63A is determined such that the distance between the guide groove 63A and the supporting plate 61 corresponds to that between the guide rail 11 and the bottom plate 14. When the sheet cassette 1 is inserted in the space 60, the guide rail 11 is inserted in the guide groove 63A and the sheet cassette 1 is guided in the straight direction of the guide grooves 63A. To facilitate insertion of the sheet cassette 1, the end of the guide groove 63A, near the opening, is wider than at the opposite end. Further, at the ends away from the opening, the wall 63B is formed. Accordingly, the insertion of the sheet cassette 1 is completed when the front face of the guide rail 11 contacts the wall 63B.

A pick up roller 71 supported by a shaft 72 is provided in the apparatus 2. The pick up roller 71 is made of an elastic material such as urethane rubber. Both ends of the shaft 72 are rotatably supported by a supporting plate (not shown) and the shaft 72 is rotated by a drive mechanism (not shown). The pick up roller 71 is located at a position such that it does not contact the uppermost one of cut sheets 3, accommodated in the sheet cassette 1, while the plate 20 is blocked by the protrusion 42A, but such that it contacts the uppermost cut sheet 3 after the plate 20 is no longer blocked by the protrusion 42A.

A protrusion 91 is provided in the apparatus 2 in such a fashion that it enters the sheet cassette 1 through the opening 12 when the sheet cassette 1 is inserted In the space 60. As the sheet cassette 1 continues to be pushed into the space 60, the lever 42B contacts the surface 91A which is inserted in the paper cassette 1. This causes the lever 42B to be moved backwards. This rotates the arm 42 clockwise and the plate 20 is no longer blocked by protrusion 42A.

As a result, the plate 20 is rotated counterclockwise by the force of the spring 51, and the pick up roller 71 contacts the uppermost cut sheet accommodated in the sheet cassette 1. After removing the sheet cassette 1 from the imaging apparatus 2 the plate 20 must be returned to its lowest position (i.e., protrusion 24 must be below protrusion 42A of arm 42) by manually pushing the cut sheets toward the bottom plate 11, before reinserting it into the imaging apparatus 2.

To judge whether the sheet cassette 1 has been completely inserted, a determining unit is provided in the apparatus 2. The determining unit is provided with an arm 65 and a photosensor 66. The arm 65 is set to be movable. When the sheet cassette 1 has not been completely inserted in the apparatus 2, the blade of the arm 65 does not interrupt the optical path of the photosensor 66. When the sheet cassette 1 has been inserted into the apparatus, (i.e., when the protrusion 24 no longer blocks the protrusion 42A), the blade of the arm 65 interrupts the optical path of the photosensor 66. Therefore, the optical path is interrupted, and it is determined that the sheet cassette 1 has been completely inserted.

It would be clear that the present invention is not limited to the embodiment described above, nor those illustrated in the drawings, and the invention can be modified without departing from the spirit and scope of the claimed invention.

The present disclosure relates to subject matters contained in Japanese Utility Model Application No. HEI4-18415 (filed on Feb. 27, 1992) which is expressly incorporated herein by reference in its entirety.

What is claimed is:

1. A combination of a sheet cassette for accommodating cut sheets and an apparatus to which said sheet cassette is detachably coupled and the cut sheets are fed from the sheet cassette, apparatus comprising:

a pick-up roller on said apparatus for picking up cut sheets individually from said sheet cassette and transporting the cut sheets into said apparatus;

a straight guide path for guiding at least a front end portion of said sheet cassette into said apparatus, and said sheet cassette comprising:

a container having a periphery and an opening at said front end portion;

a support plate on which said cut sheets are placed, said support plate being movable between a lower position and an upper position;

biasing means for biasing said support plate from said lower position toward said upper position, said cut sheets on said support plate pressingly contacting said pick-up roller when said front end portion of said sheet cassette is coupled to the apparatus; and restraining means provided entirely within said periphery of said container for latching said support plate in said lower position when said sheet cassette is out of said apparatus and preventing the cut sheets and said pick-up roller from contacting each other just before the front end portion of said sheet cassette has been completely inserted into said apparatus, and said apparatus further comprising:

releasing means for releasing the latching between said restraining means and said support plate, thereby allowing contact between said cut sheets and the pick-up roller, said releasing means engaging the restraining means through said opening of said container to release the latching when said front end portion of said sheet cassette is completely inserted into said apparatus and is coupled to said apparatus.

2. The combination according to claim 1, wherein:

said sheet cassette further comprises a bottom plate, and said biasing means includes at least one spring which is provided between said bottom plate and said support plate, for biasing said support plate toward said pick up roller while said sheet cassette is coupled to said apparatus.

3. The combination according to claim 2, wherein said supporting means includes a first part and said restraining means includes a second part, said first part contacts said second part while said sheet cassette out of said apparatus whereby movement of said support plate toward said pick up roller is prevented by said restraining means.

4. The combination according to claim 3, wherein said first part of said support plate is free from contacting said second part of said restraining means when said sheet cassette is coupled to said apparatus, whereby said support plate is moved toward said pick up roller by said biasing means.

5. The combination according to claim 4, wherein said restraining means further includes a lever, said restraining means is moved relative to said support plate in accordance with movement of said lever.

6. The combination according to claim 5, wherein wherein said lever is moved by said releasing means when said sheet cassette has been coupled to said imaging apparatus.

7. The combination according to claim 1, wherein said straight guide path is located so that said pick up roller is free from contacting the cut sheets accommodated in said sheet cassette until said sheet cassette has been coupled to said imaging apparatus.

8. A sheet feeding mechanism, comprising:

a main body;

a container having a periphery and an opening at a front end portion, said container accommodating cut sheets therein, and being detachably coupled to said main body;

means for guiding at least a front end portion of said container in a straight path in said main body;

said container including a support plate on which said cut sheets are placed, said support plate being movable between a lower position and an upper position;

means, provided in said main body, for picking-up the cut sheets individually from said container;

means for biasing said support plate from said lower position toward said upper position, the cut sheets on said support plate pressingly contacting said pick-up means, when said front end portion of said container is coupled to said main body;

restraining means, provided entirely within said periphery of said container for latching said support plate in said lower position when said container is out of said main body and preventing the cut sheets and pick-up means from contacting each other just before the front end portion of said container has been completely inserted into said main body; and releasing means, provided in said main body, for releasing said restraining means and said support plate, thereby allowing contact between said cut sheets and said pick-up means, said releasing means engaging said restraining means through said opening of said container to release the latching when said front end portion of said container is completely inserted into said main body and is coupled to said main body.

9. A sheet cassette for accommodating cut sheets therein and being detachably coupled to an apparatus to which the cut sheets are to be fed, comprising:

a cassette housing having a periphery and an opening at a front end portion;

supporting means, provided in said cassette housing, for supporting cut sheets thereon and being movable in a predetermined direction transverse to a feeding direction of the cut sheets;

biasing means for biasing said supporting means in the predetermined direction;

restraining means provided entirely within said periphery of said cassette housing and being able to be contacted through said opening for releasing said supporting means, said restraining means preventing movement of said supporting means in the predetermined direction while said cassette housing is being inserted into said apparatus and allowing movement of said supporting means when said cassette housing has been completely inserted into said apparatus and is coupled to said apparatus.

10. The sheet cassette according to claim 9, wherein said cassette housing includes a bottom plate, and said biasing means includes at least one spring which is provided between, said bottom plate and said supporting means, for biasing said supporting means in said predetermined direction while said sheet cassette is coupled to said apparatus.

11. The sheet cassette according to claim 10, wherein said supporting means includes a first part and said restraining means includes a second part, said first part contacts said second part while said sheet cassette is out of said apparatus whereby the movement of said supporting means in the predetermined direction is prevented by said restraining means.

12. The sheet cassette according to claim 11, wherein said first part of said supporting means is free from contacting said second part of said restraining means when said sheet cassette is coupled to said apparatus, whereby said supporting means is moved in said predetermined direction by said biasing means.

13. The sheet cassette according to claim 12, wherein said restraining means further includes a lever, said restraining means is moved relative to said supporting means in accordance with movement of said lever.

14. The sheet cassette according to claim 13, wherein wherein said lever is moved by said releasing means when said sheet cassette has been coupled to said apparatus.

15. A combination of a sheet cassette for accommodating cut sheets and an apparatus to which said sheet cassette is detachably coupled and the cut sheets are fed from said sheet cassette, said apparatus comprising:

a pick-up roller on said apparatus for picking up the cut sheets individually from said sheet cassette and transporting the cut sheets into said apparatus; and a straight guide path for guiding at least a front end portion of said sheet cassette, and said sheet cassette comprising:

a container having a periphery and an opening at said front end portion;

a support plate on which said cut sheets are placed, said support plate being movable between a lower position and an upper position;

biasing means for biasing said support plate from said lower position toward said upper position, the cut sheets on said support plate pressingly contacting said pick-up roller when said front end portion of said sheet cassette is coupled to said apparatus; and restraining means provided entirely within said periphery of said container for latching said support plate in said lower position when said sheet cassette is out of said apparatus and preventing the cut sheets and said pick-up roller from contacting each other just before the front end portion of said sheet cassette has been completely inserted into said apparatus, and said combination comprising:

releasing means for releasing the latching between said restraining means and said support plate upon insertion of said sheet cassette into said apparatus, said releasing means engaging said restraining means through said opening of said container to release the latching when the front end portion of said sheet cassette is completely inserted into said apparatus, thereby allowing contact between the cut sheets and said pick-up roller.

16. The combination according to claim 15, wherein said releasing means is provided to said apparatus.

* * * * *

UNITED STATES PATENT AND TRADEMARK OFFICE

CERTIFICATE OF CORRECTION

PATENT NO. : 5,338,021
DATED : August 16, 1994
INVENTOR(S) : Masami SHIRAI

It is certified that error appears in the above-indentified patent and that said Letters Patent is hereby corrected as shown below:

At column 5, line 47 (claim 1, line 4), change "the sheet cassette, apparatus" to ---said sheet cassette, said apparatus---.

At column 6, line 9 (claim 1, line 34), change "the" to ---said---.

At column 6, line 10 (claim 1, line 35), change "the" to ---said---.

At column 6, line 27 (claim 3, line 5), change "cassette out" to ---cassette is out---.

At column 6, line 28 (claim 3, line 6), change "pick up" to ---pick-up---.

At column 6, line 35 (claim 4, line 6), change "pick up" to ---pick-up---.

At column 6, line 42 (claim 6, line 2), delete "wherein".

At column 8, line 11 (claim 14, line 2), delete "wherein".

Signed and Sealed this

Eighteenth Day of April, 1995

Bruce Lehman

*Attest:*

BRUCE LEHMAN

*Commissioner of Patents and Trademarks*

*Attesting Officer*